US005287684A

United States Patent [19]

Beroth

[11] Patent Number: 5,287,684

[45] Date of Patent: Feb. 22, 1994

[54] DEBRIS COLLECTION VEHICLE

[76] Inventor: Charles J. Beroth, 2400 Vienna-Dozier Rd., Pfafftown, N.C. 27040

[21] Appl. No.: 960,691

[22] Filed: Oct. 14, 1992

[51] Int. Cl.[5] ..... A47L 5/22; B08B 5/04

[52] U.S. Cl. ..... 56/13.2; 56/16.6; 15/340.1; 15/422.2

[58] Field of Search ..... 56/12.8, 12.9, 13.2, 56/13.3, 13.5, 14.4, 14.6, 16.6, 328.1, 320.2; 15/340.1, 422.2

[56] References Cited

U.S. PATENT DOCUMENTS

| | | | |
|---|---|---|---|
| 2,669,078 | 2/1954 | Gregory | 56/13.2 |
| 2,990,019 | 6/1961 | Finn | 56/12.9 X |
| 3,184,777 | 5/1965 | Norden | 56/13.2 X |
| 3,688,479 | 9/1972 | Martinson et al. | 56/13.2 |
| 3,903,565 | 9/1975 | Hicks | 15/352 |
| 4,193,249 | 3/1980 | Tackett | 56/11.9 |
| 4,426,830 | 1/1984 | Tackett | 56/202 |
| 4,433,532 | 2/1984 | McCunn | 56/320.2 |
| 4,761,943 | 8/1988 | Parker | 56/202 |
| 4,819,417 | 4/1989 | Bryant | 56/202 |
| 4,881,362 | 11/1989 | Parker | 56/202 |

*Primary Examiner*—Stephen J. Novosad
*Attorney, Agent, or Firm*—W. Thad Adams, III

[57] ABSTRACT

A debris collection vehicle including a vehicle chassis mounted on wheels, a motor carried on the vehicle and a debris pick-up apparatus mounted on the vehicle and powered by the motor for collecting debris off of the ground. The debris pick-up apparatus includes an elongate sweeper driven by the motor for sweeping debris in the path of the vehicle and three pick-up fans powered by the motor and mounted downstream of the sweeper for receiving debris swept from the ground by the sweeper. A grinder is powered by the motor and mounted downstream from the three pickup fans for receiving debris picked up by the pick-up fans and grinding the debris into smaller-sized debris. The vehicle includes a collection container for the ground up debris carried on the rear of the chassis.

17 Claims, 10 Drawing Sheets

DEBRIS COLLECTION VEHICLE

TECHNICAL FIELD AND BACKGROUND OF THE INVENTION

This invention relates to a debris collection vehicle particularly intended for heavy duty, high volume commercial and industrial debris pickup. The vehicle is designed to be suitable for use on golf courses, parks, large lawns and even lightly wooded areas. Many light duty collection vehicles are known, and are essentially little more than riding lawn mowers which can pick up leaves, grass and very small twigs. See, for example, U.S. Pat. Nos. 4,433,532 and 4,426,830.

Other devices are known which are pulled by other vehicles, such as tractors, but perform essentially the same functions. See, for example, U.S. Pat. Nos. 4,761,943 and 3,903,565.

Still other devices, such as parking lot sweepers and the like, are built on truck bodies and are very expensive, but still perform primarily a vacuuming function.

The present invention is intended specifically to sweep up not only grass, leaves and similar materials, but also large pine cones, sticks, garbage and any other debris which can be reduced in size by grinding. The debris is substantially reduced in size and therefore concentrated, so that a much larger amount can be discharged into a collection container. A very large collection container is provided, so that it needs to be emptied relatively infrequently.

Low pressure golf cart-type tires permit use on soft turf areas. Organic material collected and ground is reduced to such small size that it can be used as mulch, and will quickly decompose into organic material suitable for enriching soil.

SUMMARY OF THE INVENTION

Therefore, it is an object of the invention to provide a debris collection vehicle.

It is another object of the invention to provide a debris pick-up apparatus which is completely self-contained.

It is another object of the invention to provide a debris pick-up apparatus which effectively collects many types of ground debris, including relatively large, heavy material.

It is another object of the invention to provide a debris pick-up apparatus which grinds the debris collected into smaller-sized material which is compact and easy to transport.

It is another object of the invention to provide a debris pick-up apparatus which grinds organic material into mulch.

These and other objects of the present invention are achieved in the preferred embodiments disclosed below by providing a debris collection vehicle comprising a vehicle chassis mounted on wheels, a motor carried on the vehicle and a debris pick-up apparatus mounted on the vehicle and powered by the motor for collecting debris off of the ground. The debris pick-up apparatus includes an elongate sweeper driven by the motor for sweeping debris in the path of the vehicle and at least one pick-up fan powered by the motor and mounted downstream of the sweeper for receiving debris swept from the ground by the sweeper. A grinder is powered by the motor and mounted downstream from the at least one pick-up fan for receiving debris picked up by the pick-up fan and grinding the debris into smaller-sized debris.

According to one preferred embodiment of the invention, the at least one pick-up fan comprises first and second pick-up fans mounted adjacent opposite ends of the sweeper for directing debris swept by the sweeper to a central position between the first and second pick-up fans; a third pick-up fan for receiving the debris from the first and second pick-up fan and delivering it to the grinder.

According to another preferred embodiment of the invention, the debris pick-up apparatus includes a sweeper housing, a pick-up fan housing and a grinder housing for enclosing the respective sweeper, at least one pick-up fan and grinder.

According to yet another preferred embodiment of the invention, the debris pick-up apparatus includes discharge means for delivering ground-up debris from the grinder and a collection container carried by the vehicle for receiving and collecting the ground-up debris from the discharge means between periodic emptying.

Preferably, sweeper includes an elongate shaft and a plurality of elongate sweeper blades carried by and extending along the length of the shaft at spaced intervals around the shaft for successively sweeping against the ground as the shaft and the sweeper blades carried thereon rotate.

Preferably, the sweeper extends transverse to the direction of travel of the vehicle, and the sweeper blades are formed of a flexible, durable material chosen from rubber or plastic.

According to one preferred embodiment of the invention, the grinder comprises a shaft and a plurality of grinder blades mounted on the shaft. The grinder housing includes a grinder housing inlet formed in the grinder housing and oriented in axial alignment with the grinder shaft for introducing debris into the grinder housing in an orientation perpendicular to the direction of movement of the grinder blades. A grinder housing outlet is formed in the grinder housing in radial alignment with the grinder blades and perpendicular to the orientation of the grinder housing inlet for permitting radial discharge of debris from the grinder housing.

Preferably, the grinder blades are curved in the direction of the axis of rotation of the grinder shaft.

According to one preferred embodiment of the invention, the grinder housing inlet has a relatively large cross-sectional area and the grinder housing outlet has a relatively small cross-sectional area for accelerating the debris out of the grinder housing through the grinder housing outlet and for further grinding the debris.

According to another preferred embodiment of the invention, first and second pick-up fans are mounted adjacent opposite ends of the sweeper for directing debris swept by the sweeper to a central position between the first and second pick-up fans. A third pick-up fan is provided for receiving the debris from the first and second pick-pp fan and delivering it to the grinder. A pick-up fan housing encloses the first, second and third pick-up fans, and includes bulkheads positioned in the housing for directing debris within the pick-up fan housing from the first and second pick-up fans and from the third pick-up fan to a pick-up fan outlet formed in the pick-up fan housing.

According to another preferred embodiment of the invention, the first and second pick-up fans are approximately one-half the diameter of the third pick-up fan.

Preferably, the sweeper includes four sweeper blades spaced at equal distances from adjacent blades. The adjacent sweeper blades are carried perpendicular to each other and the opposing sweeper blades are parallel to each other.

According to yet another preferred embodiment of the invention, the vehicle chassis is mounted on low pressure golf cart wheels and the debris pick-up apparatus is mounted on the front of the chassis and extends into ground-engaging position. A collection container is mounted on and carried by the rear of the chassis remote from the debris pick-up apparatus. Debris conduit means extends from the pick-up apparatus in the front of the chassis to the collection container on the rear of the chassis.

According to yet another preferred embodiment of the invention, the debris collection vehicle includes steering means and power control means for use by an operator.

According to yet another preferred embodiment of the invention, support wheels are carried by the debris pick-up apparatus for supporting the debris pick-up apparatus at a predetermined distance above the ground.

According to yet another preferred embodiment of the invention, the motor provides motive force to power the movement of the chassis along the ground, and includes clutch means for alternately engaging and disengaging the operation of the debris pick-up apparatus.

Preferably, the collection container has a capacity of at least 30 bushels.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
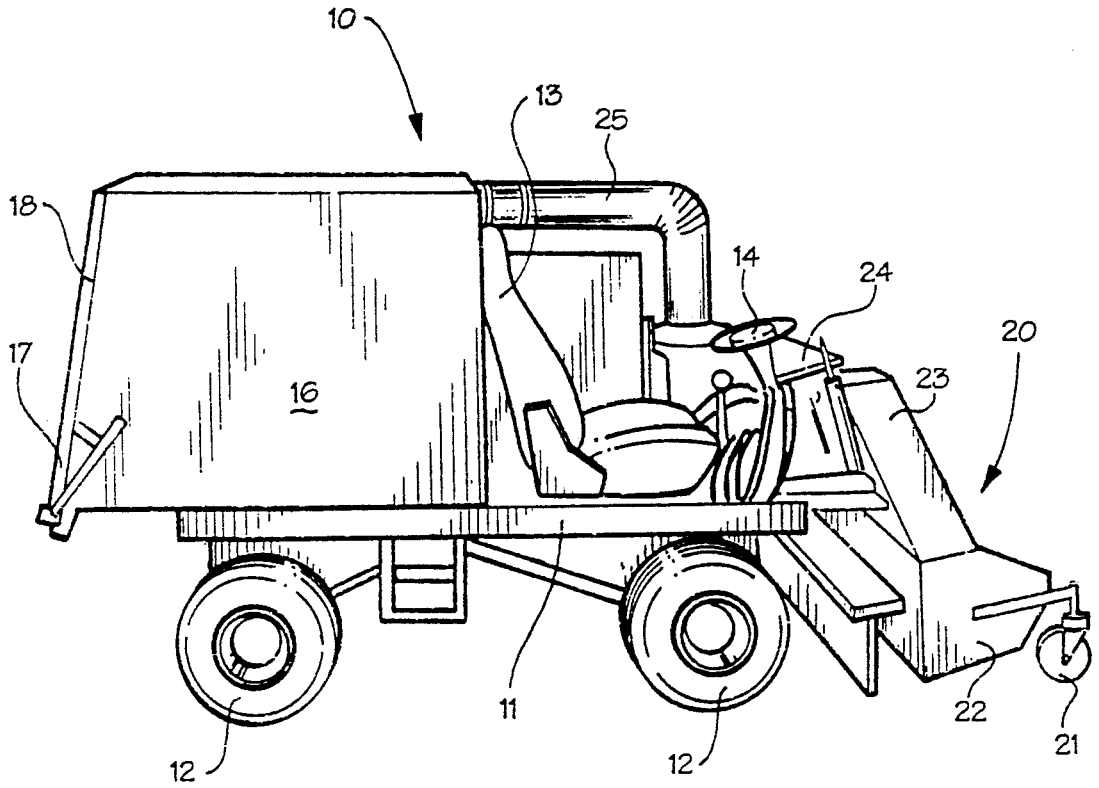
FIG. 1 is a side view of the debris collection vehicle according to an embodiment of the invention.

Referring now specifically to the drawings, a debris collection vehicle according to the present invention is illustrated in FIG. 1 and shown generally at reference numeral 10. Vehicle 10 includes a chassis 11 mounted on relatively large, low pressure tires 12, such as are used on golf carts. An operator seat 13, steering wheel 14 and other conventional operator controls are mounted on the chassis 11. A collection container 16 is mounted on the rear of the chassis 11 and includes a back cover 17 which covers a back opening 18. When the back cover 17 is opened most of the contents will spill out of the back opening. If desired, collection container 16 can be pivoted upwardly from the front side (not shown) in order to promote spillage of the contents out of the back opening 18. The pivot movement is controlled by a hydraulic piston and cylinder assembly controlled by the operator from his seat in the front of the vehicle 10.

A debris pick-up apparatus shown at broad reference number 20 is mounted on the front end of chassis 11, and is supported in a predetermined position, which can be adjusted, above the ground by a pair of support wheels 21 (one shown). The debris pick-up apparatus 20 is mounted so that it floats through a range of vertical motion as the debris pick-up apparatus 20 encounters irregularities in the terrain. The debris pick-up apparatus 20 broadly includes a sweeper housing 22, a pick-up fan housing 23 and a grinder housing 24. Ground-up refuse exits the grinder housing 24 and is conveyed by a conduit 25 to the collection container 16 on the rear of the chassis 11.

Figure 2:
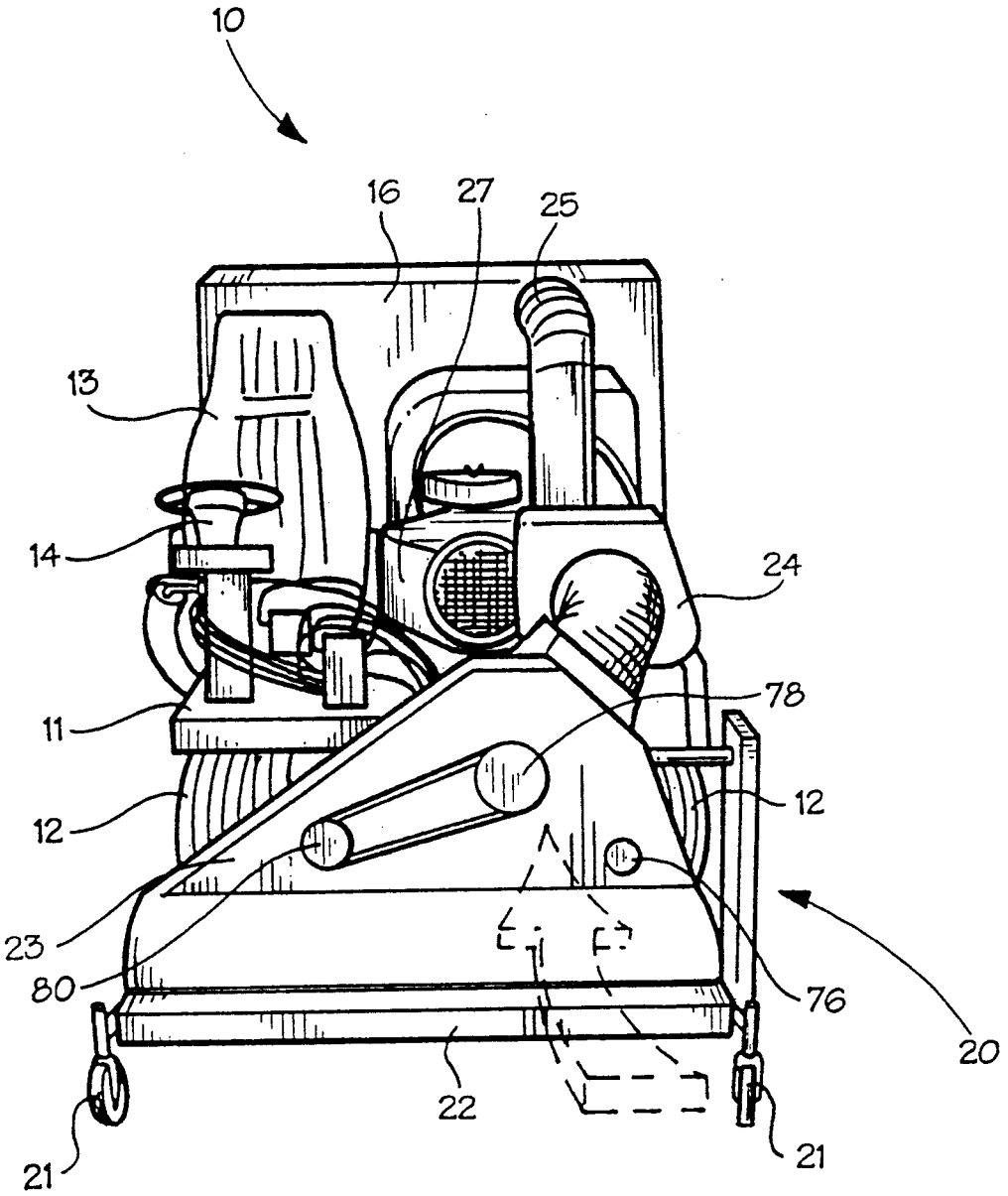
FIG. 2 is a front view of the debris collection vehicle shown in FIG. 1.

Referring now to FIG. 2, the grinder housing extends transversely across the front end of the chassis 11. Both the vehicle itself and the debris pick-up apparatus 20 are powered by a gasoline-powered internal combustion engine 27 , providing, for example 20 horsepower.

Figure 3:
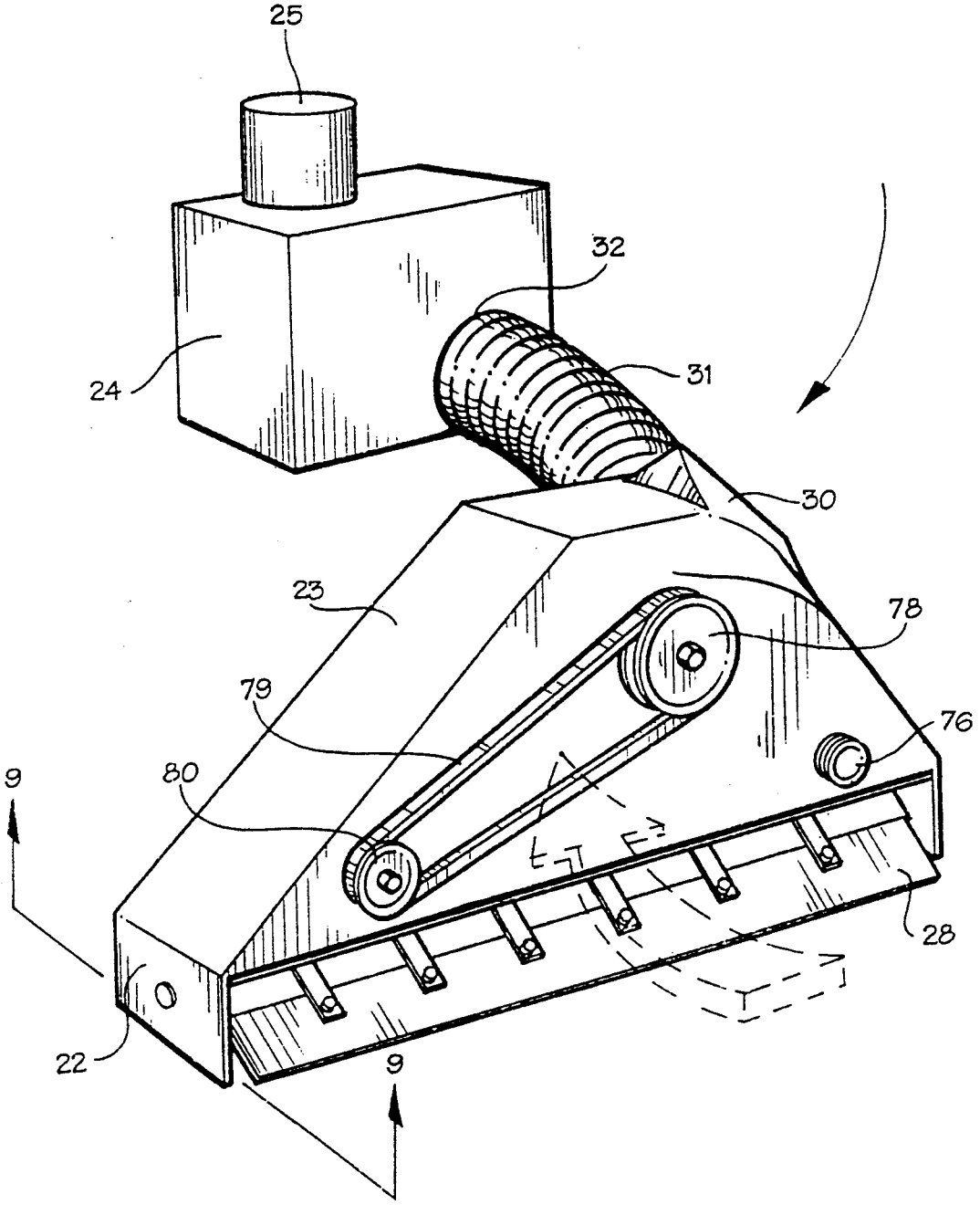
FIG. 3 is a fragmentary perspective view showing the sweeper, pick-up and grinder housings.

The debris pick-up apparatus 20 is shown in further detail in FIG. 3. A sweeper 28 is mounted for rotation in the sweeper housing 22. Debris from the sweeper housing 22 passes into the pick-up fan housing 23. Debris entrained in rapidly moving air exits the pick-up fan housing 23 through a pick-up fan housing outlet 30. A short length of conduit 31 conveys the debris to the grinder housing 24 through a grinder housing inlet 32. Ground up debris exits the grinder housing 24 through a grinder housing outlet 25.

Figure 4:
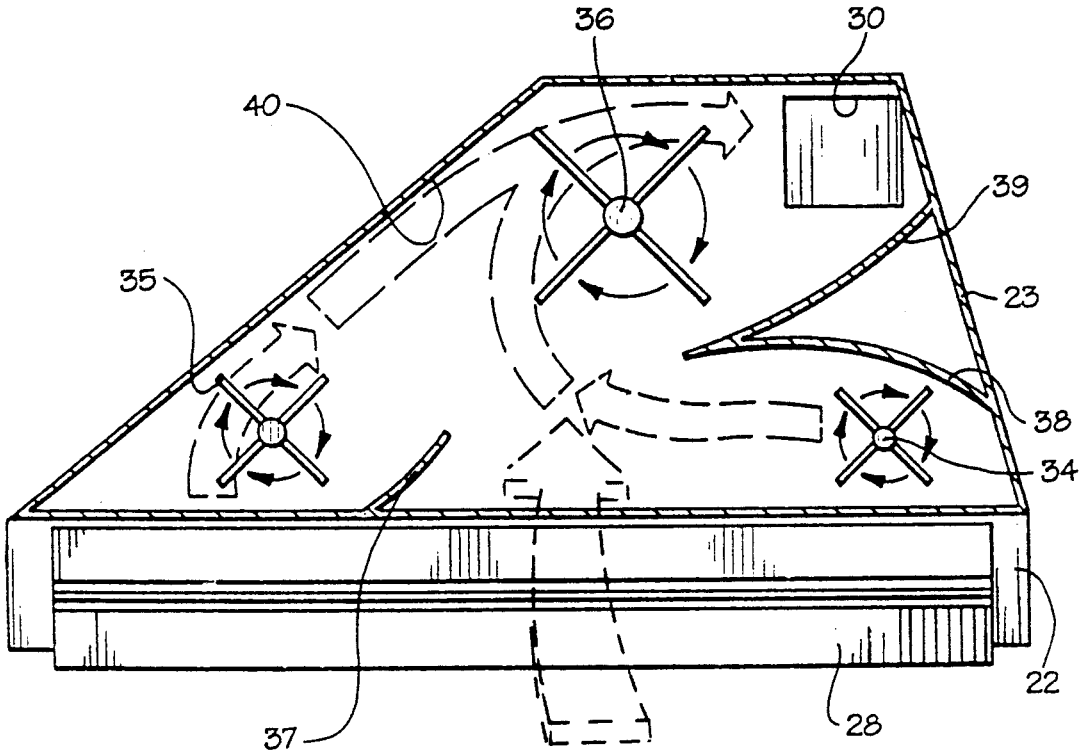
FIG. 4 is a vertical cross-section of the sweeper and pick-up housings.

By reference to FIG. 4, the interior of the pick-up housing 23 is shown. Three pick-up fans, two small pick-up fans 34 and 35 and a large pick-up fan 36 are mounted inside pick-up housing 23. Each of the fans 34, 35 and 35 rotate clockwise. Bulkheads 37, 38 and 39, together with the inside wall 40 of the pick-up fan housing 23 directs the debris-laden air upwardly from the sweeper housing 22, through the pick-up housing 23 and out through the pick-up housing outlet 31. The blades of the pick-up fans 34, 35 and 36 are steel, and begin the process of reducing the size of the debris swept into the pick-up fan housing 23 by the sweeper 28.

Figure 5:
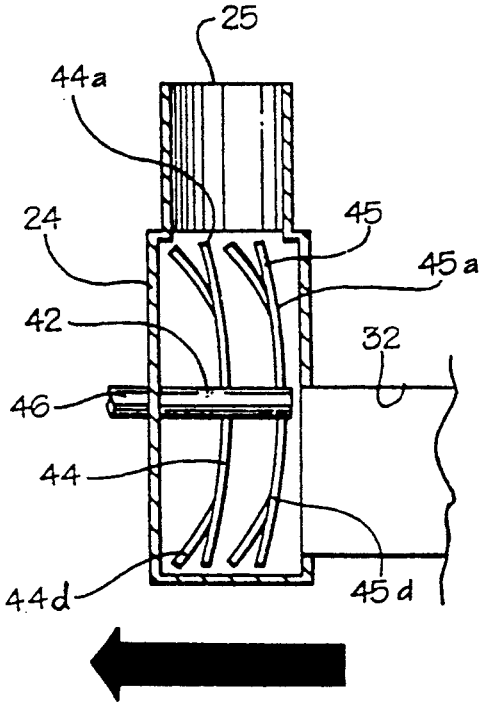
FIG. 5 is a side cross-section of the grinder housing.
Figure 6:
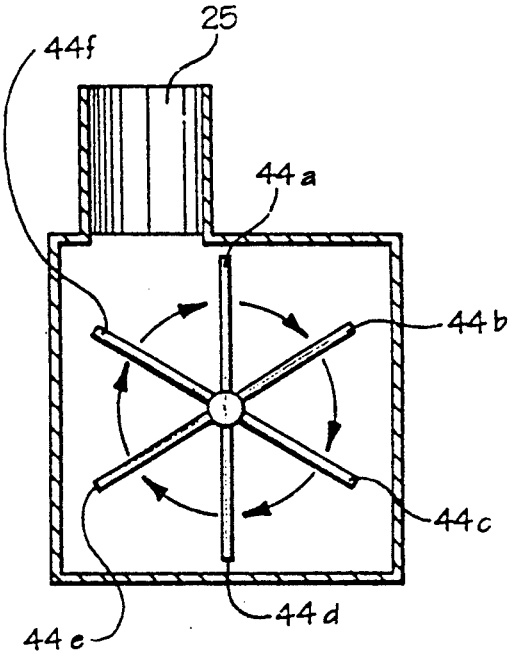
FIG. 6 is a front cross-section of the grinder housing shown in FIG. 5, taken at 90 degrees from the FIG. 5 view.

As is shown in FIG. 5, the grinder housing 24 encloses a grinder 42, which is constructed of first and second sets of blades 44 and 45. Each set 44 and 45 are respectively formed of six steel blades **44*a*–44*f* and 45*a*–45*f*, spaced at uniform intervals around a single shaft 46. Note that the sets of blades 44 and 45 are curved, and provide the primary grinding function of the debris collection vehicle 10. 10 As is seen by simultaneous reference to FIGS. 5 and 6, the grinder housing inlet 32 is formed in the grinder housing 24 and oriented in axial alignment with the grinder shaft 46 in order to introduce debris into the grinder housing 24 in a orientation perpendicular to the direction of movement of the sets of grinder blades 44 and 45. The grinder housing outlet 25 is formed in the grinder housing 24 in radial alignment with the sets of grinder blades 44 and 45, and perpendicular to the orientation of the grinder housing inlet 32 to permit radial discharge of debris from the grinder housing 24. The requires the debris to pass both axially and radially through the grinder housing 24, insuring efficient grinding along a relatively long path through the grinder housing 24**.

Figure 7:
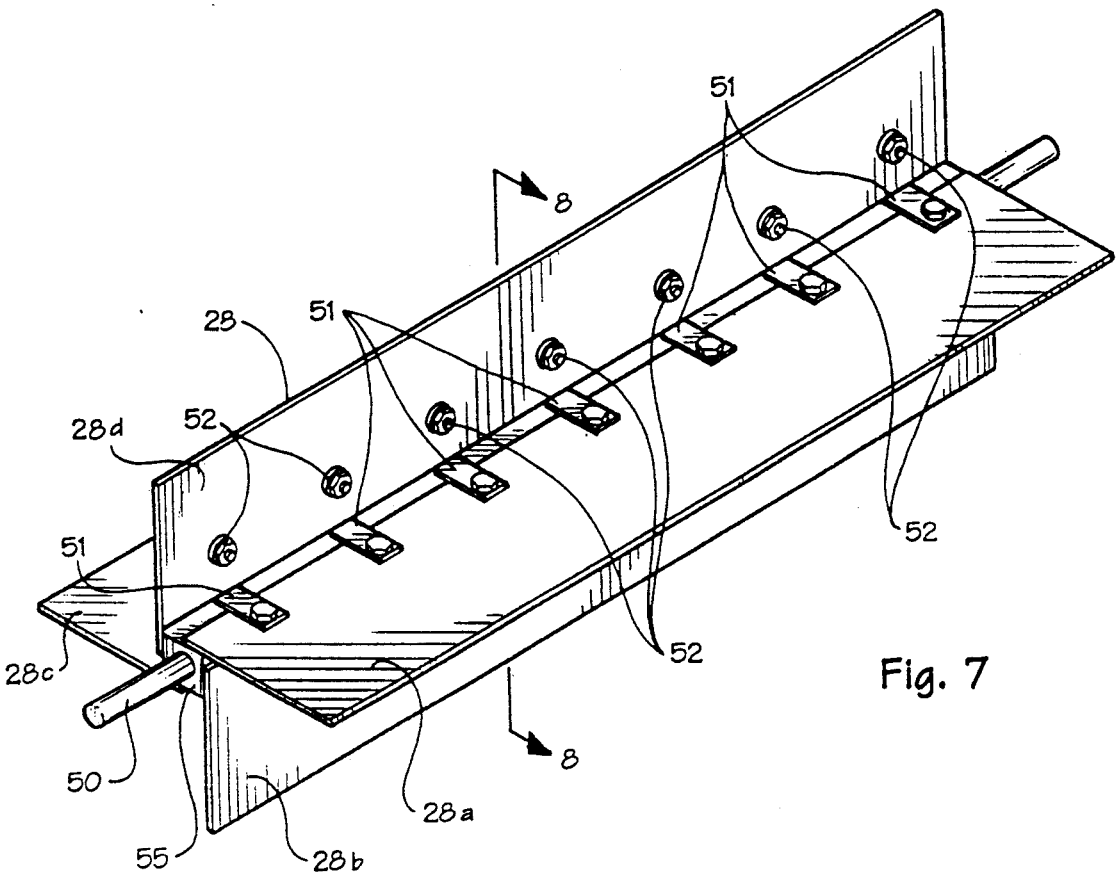
FIG. 7 is a perspective view of the sweeper.
Figure 8:
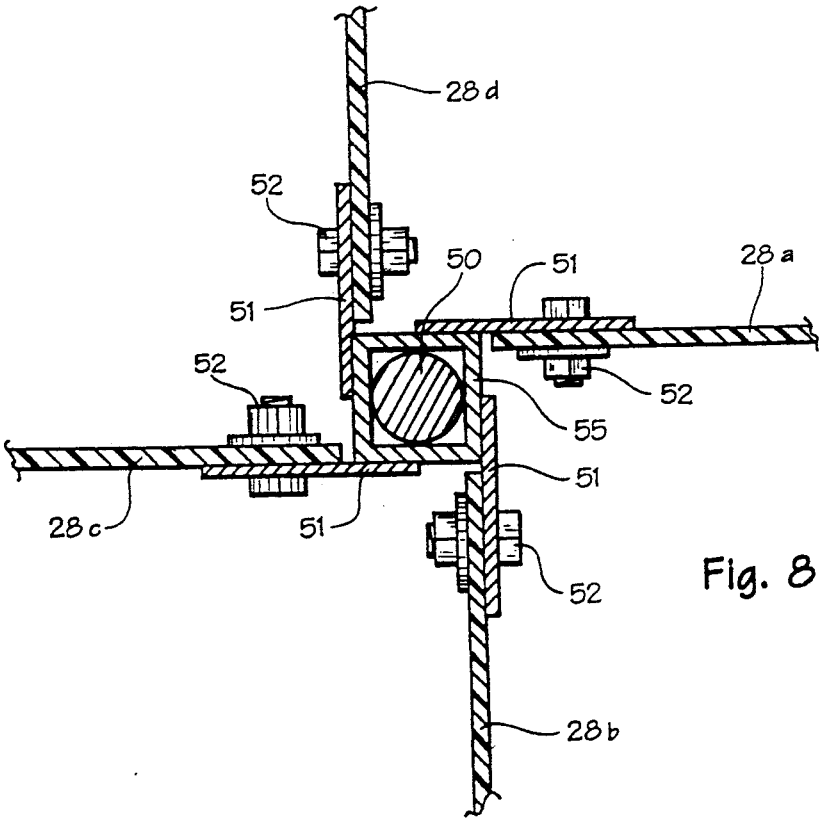
FIG. 8 is a cross-section taken along lines 8—8 of FIG. 7.

The construction of the sweeper blade 28 is shown in further detail in FIGS. 7 and 8. The sweeper 28 includes four sweeper blades 28*a*–28*d* spaced at equal distances from adjacent blades. Adjacent sweeper blades 28*a*–28*d* are carried perpendicular to each other, and opposing sweeper blades 28*a*–28*d* are parallel to each other. Blades 28*a*–28*d* are constructed of heavy duty, wear resistant rubber or plastic, and are mounted onto sweeper shaft 50 by means of a series of brackets 51. Each of the brackets 51 is welded onto a square tube 55 which in turn is welded to shaft 50. Nut and bolt assemblies 52 hold the rubber blades 28*a*–28*d* onto tube 55, and permit periodic replacement when the blades 28*a*–28*d* become damaged or worn out.

Figure 9:
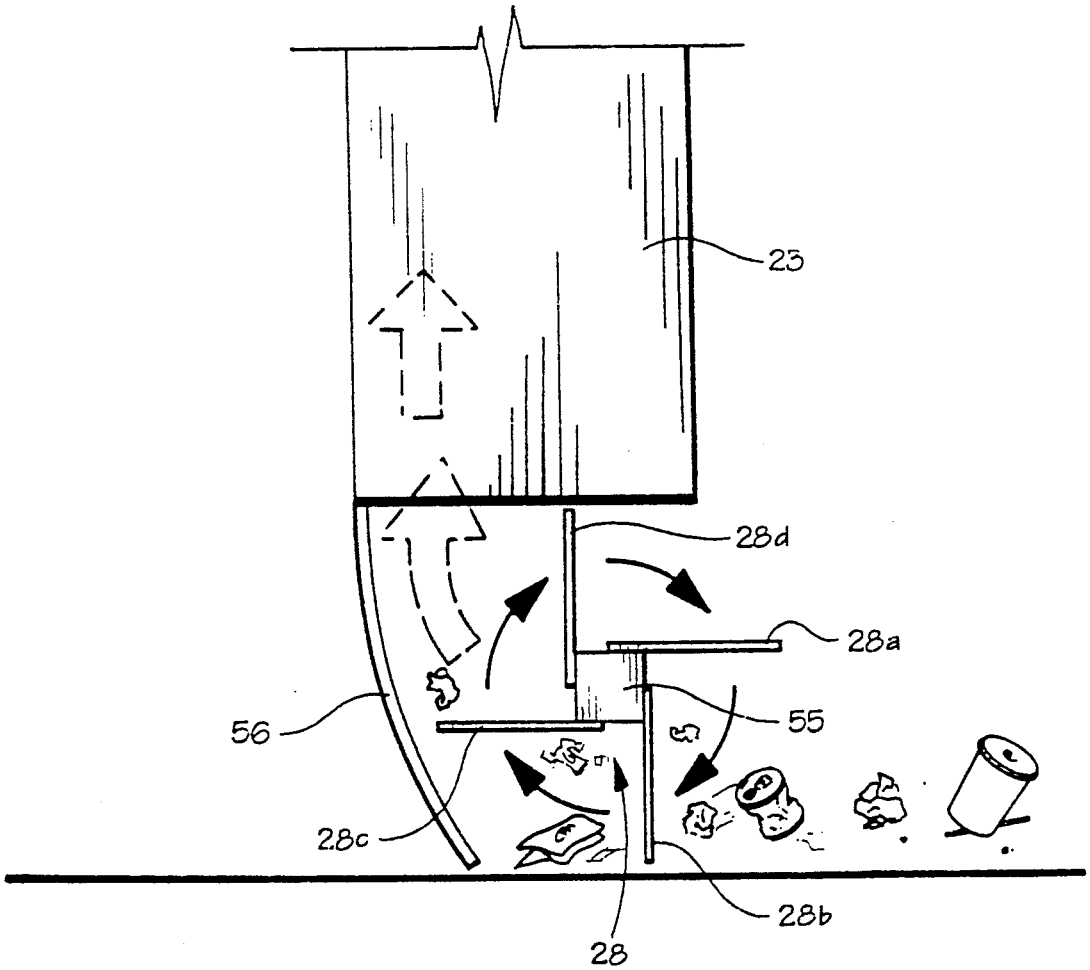
FIG. 9 is a fragmentary side elevation of the sweeper and pick-up housings viewed along lines 9—9 of FIG. 3.

The rubber blades 28*a*–28*d* are therefore relatively flexible, and can impact the ground without damaging the turf or other ground surface. The clockwise rotation of the sweeper 28 at high speed efficiently pushes debris upwardly into the pick-up fan housing 23, as is shown in FIG. 9. A full-width flexible guide 56 prevents debris from being thrown up under and behind the blade housing 22.

Figure 10:
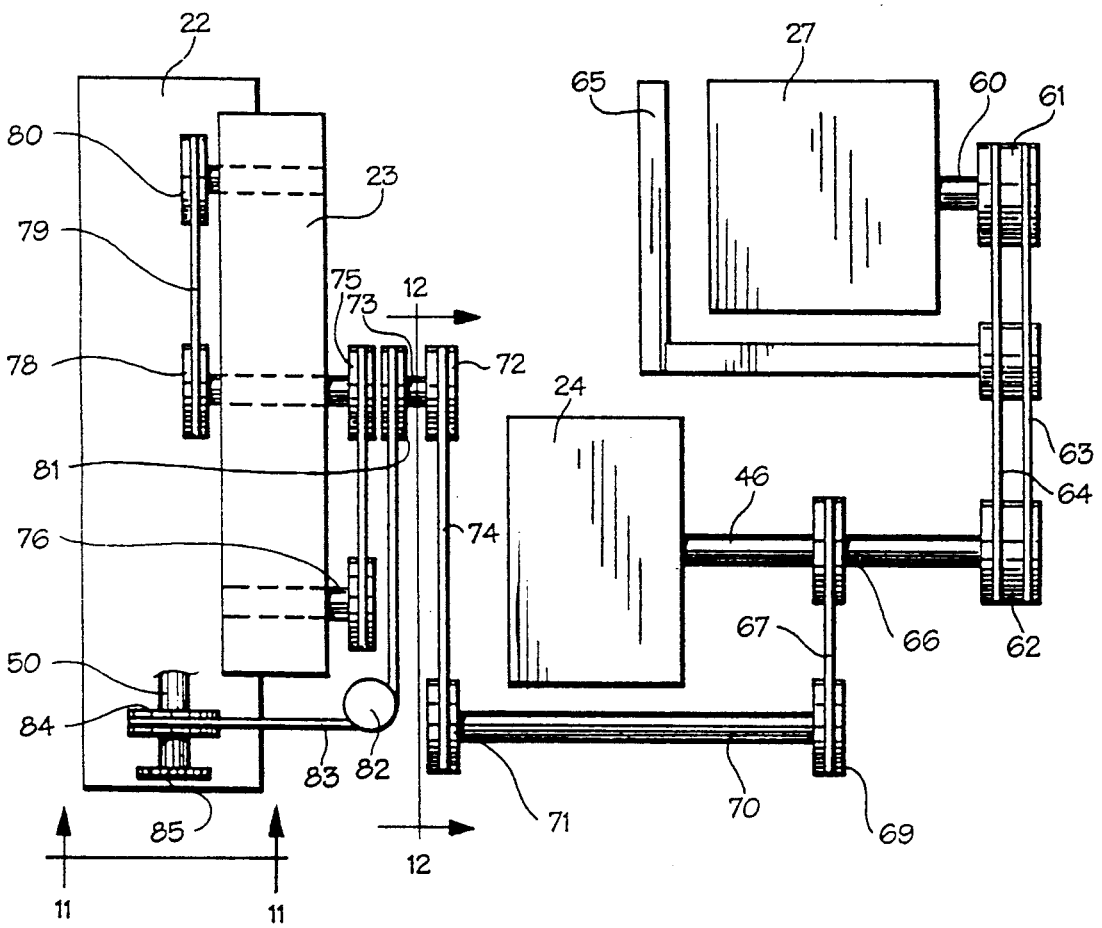
FIG. 10 is a schematic diagram of the power train of the debris collection vehicle.

The power train of the debris pick-up apparatus 20 is shown in FIG. 10. Power from gasoline engine 27 is obtained from a power take-off shaft 60. A double pulley 61 drives a double pulley 62 through double pulley belts 63, 64. A manual clutch 65 permits engagement and disengagement as needed. Pulley 62 is mounted on and rotates grinder drive shaft 46. An idler pulley 66 transfers power through a drive belt 67 to a pulley 69 mounted on the end of a power transfer shaft 70. A pulley 71 drives a pulley 72 mounted on the end of a pick-up fan drive shaft 73 through a drive belt 74. The pick-up drive shaft 73 directly drives the large pick-up fan 36. A pulley 75 drives a shaft 76 on which rotates the small pick-up fan 34. The other small pick-up fan 35 is driven by a pulley 78 by drive belt 79 driving a pulley 80.

Sweeper 28 is driven by a pulley 81 mounted on pick-up fan drive shaft 73. The axis of rotation is changed through a pulley 82. A drive belt 83 drives a pulley 84. 50.

Figure 11:
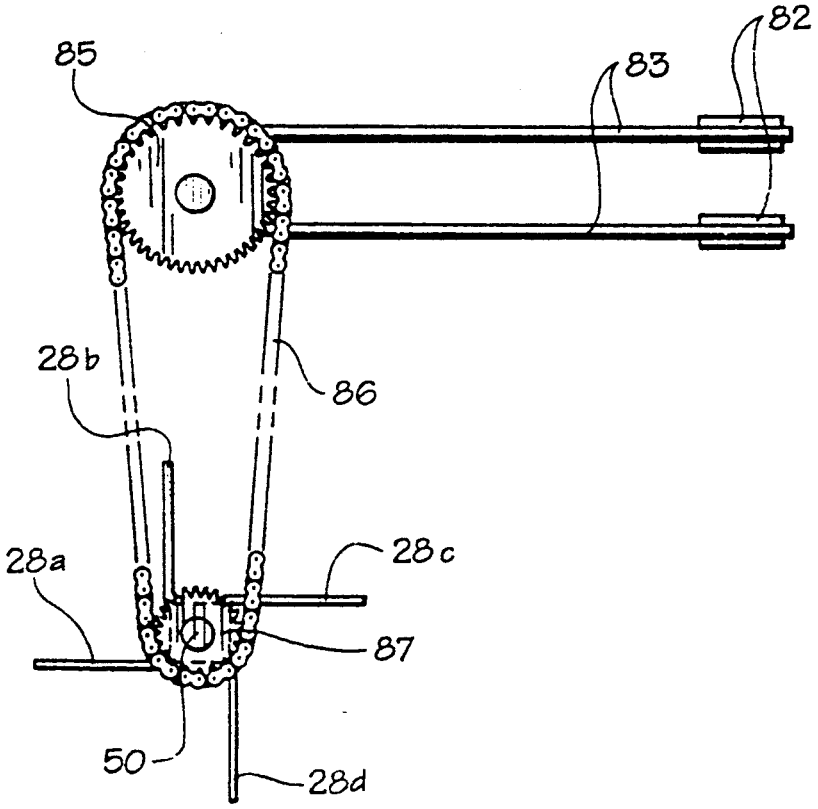
FIG. 11 is a cross-section taken along lines 11—11 of FIG. 10.
Figure 12:
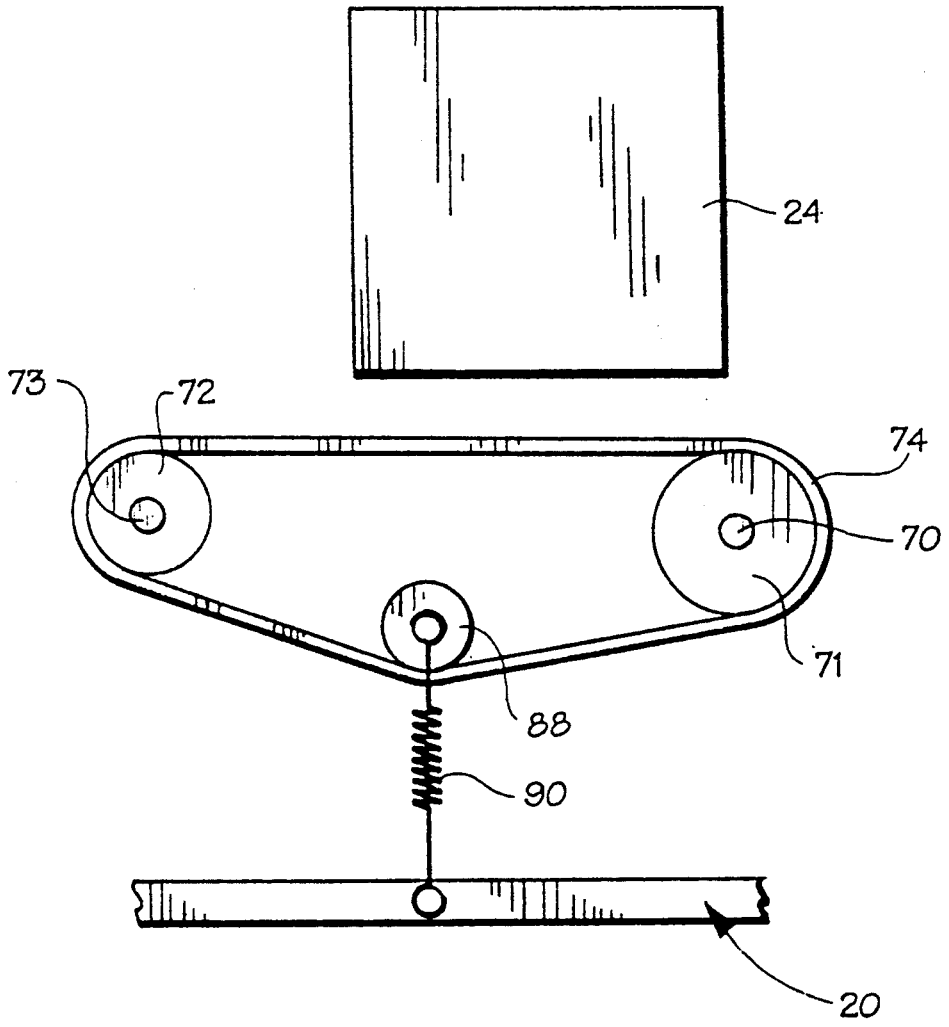
FIG. 12 is a cross-section taken along lines 12—12 of FIG. 10.

Referring now to FIG. 11, the pulley 84 has a sprocket gear 85 mounted thereon. A sprocket chain 86 drives a sprocket gear 87 carried on the end of shaft 50.

As is apparent from the above description, the power transfer shaft 70 is fixed, while the pick-up fan drive shaft 73 and pulley 72 move with the debris pick-up apparatus 20. To accommodate this movement, a spring-loaded idler pulley 88 takes up tension o belt 74 caused by movement of the debris pick-up apparatus 20. Spring 90 is mounted to the debris pick-up apparatus 20 and moves with the debris pick-up apparatus 20.

A debris collection vehicle is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A debris collection vehicle, comprising:

(a) a vehicle chassis mounted on wheels;

(b) a motor carried on said vehicle;

(c) a debris pick-up apparatus mounted on said vehicle and powered by said motor for collecting debris off of the ground, said debris pick-up apparatus comprising:

(1) an elongate sweeper driven by said motor for sweeping debris in the path of the vehicle;

(2) at least one pick-up fan powered by said motor and mounted downstream of the sweeper for receiving debris swept from the ground by the sweeper, said at least one pick-up fan comprising first and second pick-up fans mounted adjacent opposite ends of said sweeper for directing debris swept by the sweeper to a central position between said first and second pick-up fans; and a third pick-up fan for receiving the debris from the first and second pick-up fans; and (3) a grinder powered by said motor and mounted downstream from said at least one pick-up fan for receiving debris from said third pick-up fan picked up by the first and second pick-up fan and grinding the debris into smaller-sized debris.

2. A debris collection vehicle according to claim 1, and including a sweeper housing, a pick-up fan housing and a grinder housing for enclosing the respective sweeper, at least one pick-up fan and grinder.

3. A debris collection vehicle according to claim 1, and including:

(a) discharge means for delivering ground-up debris from said grinder; and (b) a collection container carried by said vehicle for receiving and collecting the ground-up debris from the discharge means between periodic emptying.

4. A debris collection vehicle according to claim 3, wherein said collection container has a capacity of at least 30 bushels.

5. A debris collection vehicle according to claim 1, wherein said sweeper comprises:

(a) an elongate shaft; and (b) a plurality of elongate sweeper blades carried by and extending along the length of the shaft at spaced intervals around the shaft for successively sweeping against the ground as the shaft and the sweeper blades carried thereon rotate.

6. A debris collection vehicle according to claim 5, wherein;

(a) said sweeper includes four sweeper blades spaced at equal distances from adjacent blades:

(b) said adjacent sweeper blades are carried perpendicular to each other; and (c) opposing sweeper blades are parallel to each other.

7. A debris collection vehicle according to claim 5, wherein said sweeper blades are formed of a flexible, durable material chosen from the group consisting of rubber and plastic.

8. A debris collection vehicle according to claim 1, wherein:

(a) said vehicle chassis is mounted on low pressure golf cart wheels;

(b) said debris pick-up apparatus is mounted on the front of said chassis and extends into ground-engaging position;

(c) a collection container is mounted on and carried by the rear of the chassis remote from the debris pick-up apparatus; and (d) debris conduit means extends from the pick-up apparatus in the front of the chassis to the collection container on the rear of the chassis.

9. A debris collection vehicle according to claim 8, and including steering means and power control means for use by an operator.

10. A debris collection vehicle according to claim 1, and including support wheels carried by said debris pick-up apparatus for supporting said debris pick-up apparatus at a predetermined distance above the ground.

11. A debris collection vehicle according to claim 1, wherein said motor provides motive force to power the movement of the chassis along the ground, and includes clutch means for alternately engaging and disengaging the operation of the debris pick-up apparatus.

12. A debris collection vehicle according to claim 1, wherein said sweeper extends transverse to the direction of travel of said vehicle.

13. A debris collection vehicle comprising:

(a) a vehicle chassis mounted on wheels;

(b) a motor carried on said vehicle;

(c) a debris pick-up apparatus mounted on said vehicle and powered by said motor for collecting debris off of the ground, said debris pick-up apparatus comprising:

(1) an elongate sweeper driven by said motor for sweeping debris in the path of the vehicle;

(2) at least one pick-up fan powered by said motor and mounted downstream of the sweeper for receiving debris swept from the ground by the sweeper; and (3) a grinder powered by said motor and mounted downstream from said at least one pick-up fan for receiving debris picked up by the pick-up fan and grinding the debris into smaller-sized debris, said grinder comprising:

(a) a shaft and a plurality of grinder blades mounted on said shaft; and said grinder housing comprises:

(b) a grinder housing inlet formed in said grinder housing and oriented in axial alignment with said grinder shaft for introducing debris into the grinder housing in an orientation perpendicular to the direction of movement of the grinder blades; and (c) a grinder housing outlet formed in said grinder housing in radial alignment with the grinder blades and perpendicular to the orientation of the grinder housing inlet for permitting radial discharge of debris from the grinder housing.

14. A debris collection vehicle according to claim 13, wherein said grinder blades are curved in the direction of the axis of rotation of the grinder shaft.

15. A debris collection vehicle according to claim 13, wherein the grinder housing inlet has a relatively large cross-sectional area and the grinder housing outlet has a relatively small cross-sectional area for accelerating the debris out of the grinder housing through the grinder housing outlet and for further grinding the debris.

16. A debris collection vehicle according to claim 1, including a pick-up fan housing for enclosing said first, second and third pick-up fans, and including bulkheads positioned in said housing for directing debris within said pick-up fan housing from said first and second pick-up fans and from said third pick-up fan to a pick-up fan outlet formed in said pick-up fan housing.

17. A debris collection vehicle according to claim 16, wherein said first and second pick-up fans are approximately one-half the diameter of the third pick-up fan.

* * * * *